United States Patent [19]

Eschermann et al.

[11] Patent Number: 4,689,714

[45] Date of Patent: Aug. 25, 1987

[54] ELECTRIC CONTROL DEVICE ADAPTABLE TO A TWO STATE SWITCHING DEVICE

[75] Inventors: Guy Eschermann, Quetigny; Pierre Lemarquand, Velars, both of France

[73] Assignee: La Telemecanique Electrique, France

[21] Appl. No.: 854,625

[22] Filed: Apr. 22, 1986

[30] Foreign Application Priority Data

Apr. 24, 1985 [FR] France ..... 85 06234

[51] Int. Cl.[4] ..... H01H 9/20; H01H 47/00

[52] U.S. Cl. ..... 361/167; 335/161

[58] Field of Search ..... 361/167; 335/136, 160, 335/161, 165, 166

[56] References Cited

U.S. PATENT DOCUMENTS 2,119,481 5/1938 Frese ..... 361/167

3,736,054 5/1973 Loffler et al. ..... 335/161

4,590,451 5/1986 Miyamoto ..... 335/161

*Primary Examiner*—L. T. Hix

*Assistant Examiner*—David M. Gray

*Attorney, Agent, or Firm*—William A. Drucker

[57] ABSTRACT

An electric control device adaptable to a two state switching device is provided comprising two electromagnets disposed head to tail and each having a coil inside which a coil is slidably mounted, and two rocking levers which each comprise a first arm having a toothed sector and a second arm coupled to a respective core. The two toothed sectors mesh with a toothed pinion mounted for rotation in the case. This toothed pinion may be coupled to the operating shaft of a switching device.

7 Claims, 6 Drawing Figures

ELECTRIC CONTROL DEVICE ADAPTABLE TO A TWO STATE SWITCHING DEVICE

BACKGROUND OF THE INVENTION

1. Field of the Invention

The present invention relates to an electric control device adaptable to a two state switching device, the switching control of which is provided by rotation of a shaft between two angular positions each corresponding to one of said states.

It applies advantageously, but not exclusively, to the control of a modular circuit breaker with one or more poles, of the type comprising an electromechanical circuit housed in a prismatic case which usually comprises two lateral parallel sides and, perpendicular thereto:

a front face having, in its central region, an opening through which passes a handle serving for manual setting and tripping of the circuit breaker, this handle being carried by a hollow hub or tubular shaft mounted for rotation in two coaxial orifices provided respectively on said lateral sides;

a rear face whose profile is adapted for fixing to a support rail oriented perpendicularly to said sides; and two opposite side faces, in general the upper face and the lower face, which may have orifices for connecting electrical conductors in terminals housed in the case.

2. Description of the Prior Art

These modular circuit breakers may then be assembled side by side on the support rail so as to form a circuit breaking assembly for a three phase circuit for example. The handles of these circuit breakers may be readily interlocked with each other in rotation by means of a shaft passing in the hollow hubs which, considering the nature of the assembly, are disposed coaxially with each other. Of course, for such interlocking, the bore of the hollow hub may have axial grooves and the shaft may comprise keyways engageable in said grooves.

In this type of application, the aim of the invention is more particularly the provision of an electric device for controlling modular circuit breakers, which requires little room widthwise and whose structure allows it to be integrated, with a minimum waste of space, in a case having a shape and dimensions similar to those of modular circuit breakers.

Thus, in a similar way, this case will comprise at least one rear face equipped with means for fixing to the support rail and, perpendicularly to said face and to said rail, two parallel lateral sides adapted to be applied against the lateral sides of the modular circuit breakers.

The electric control device must further comprise readily connectable and disconnectable mechanical coupling means for driving the hollow hubs, these coupling means having to be readily mountable on an assembly comprising one or more poles of modular circuit breakers assembled together.

Of course, the invention is not limited to the above described application. It provides an electric control device which generally provides for actuation of at least one switching device, whose control is provided by rotation of an operating shaft between two angular positions.

SUMMARY OF THE INVENTION

The device of the invention comprises then more particularly, housed inside a case;

two electromagnets disposed head to tail and each comprising a coil in which is mounted for axial sliding a core comprising first mechanical coupling means;

two levers mounted for oscillating about two respective axes of rotation orthogonal to the axes of sliding of the cores, each level comprising a toothed sector and a lever arm having at its free end a second coupling means cooperating with the first coupling means of a corresponding core, for transforming the active opposite linear movements of the two cores into opposite rocking movements of the associated levers;

a toothed pinion mounted for rotation in the case on a drive shaft parallel to the axes of rotation of the levers, and with which the two toothed sectors are in engagement, this drive shaft being provided with means for coupling to the operating shaft of the switching device; and a power supply circuit, adapted for alternately supplying one or other of the coils.

In the case where the electric control device is provided for controlling modular circuit breakers and is housed in a case comprising at least one rear face equipped with means for fixing to a rail or similar and, perpendicularly to said face and to said rail, two parallel lateral sides against which a modular circuit breaker may be applied, the two electromagnets are advantageously oriented parallel to said lateral sides. The drive shaft is then preferably situated so as to come into line with the actuation shaft of the modular circuit breaker. This drive shaft, as well as the actuating shafts for the modular circuit breakers, may have a tubular structure, through which may be inserted a common shaft for interlocking said shafts in rotation.

BRIEF DESCRIPTION OF THE DRAWINGS

One embodiment of the invention will be described hereafter by way of non limited example, with reference to the accompanying drawings in which.

DESCRIPTION OF THE PREFERRED EMBODIMENTS

Figure 1:
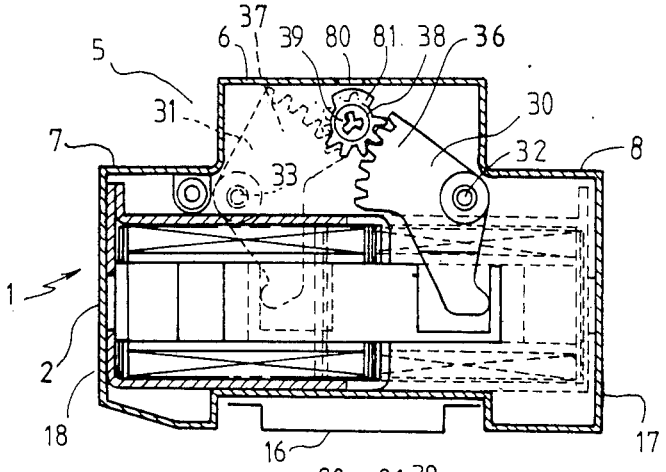
FIG. 1 is a schematic diagram of an electric control device for standard modular circuit breakers.

Such as shown in these Figures, the electric control device 1 is housed in a flat case 2 which comprises two parallel lateral sides 3, 4 (FIG. 4), a front face 5 having a central region 6 forming a stepped portion and two side regions 7, 8 having orifices 9, 10 for access to electric terminal clamping screws 11, 12 housed in the case 2, a rear face 13 which has a concave profile 15 adapted for fixing it to a support rail 16 perpendicular to the two lateral sides 3, 4 and two side faces 17, 18 comprising, in the vicinity of the front face, orifices 19, 20 for access to the electric conductors at terminals 11, 12.

Inside this case 2 are housed two electromagnets namely: a setting electromagnet 2 and a tripping electromagnet 23, disposed in the volume defined by the two lateral sides 3, 4, the two side faces 17, 18, the rear face 13 and the two side regions 7, 8 of the front face 5.

These two electromagnets 22, 23 are placed side by side with slight overlapping of one with respect to the other and in a head to tail arrangement. The setting electromagnet 22 comprises a coil 24 mounted fixedly on the side face 18 and on the rear face 13. Similarly, the tripping electromagnet 23 comprises a coil 25 fixed on the side face 17 and on the rear face 13.

These two coils 24, 25 are oriented parallel to the lateral sides 3, 4 and to the front and rear faces 5, 13 and, consequently, prependicularly to the longitudinal axis of rail 16. Inside these coils 24, 25 two cores 26, 27 are mounted for axial sliding, each comprising, outside its coil 24, 25, a transverse recess 28, 29.

These two cores 26, 27 cooperate with two respective levers 30, 31 mounted for pivoting in their median part about two pins 32, 33 perpendicular to the lateral sides 3, 4 of case 2 and housed therein in the vicinity of the angular regions 5', 5'' situated at the base of the central region 6 of the front face 5 of case 2.

Each of these levers 30, 31, comprises an arm 34, 35 whose free end is engaged in the recess 28, 29 of a corresponding core 26, 27 and another arm which is situated on the other side of its rotational pin 32, 33 and which carries a toothed sector 36, 37 meshing with a pinion 38. Pinion 38 is common to the two toothed sectors and it is carried by a drive shaft 39 which pivots in two coaxial orifices provided respectively in the two lateral sides 3, 4 in the vicinity of the central region 6 of the front face 5.

Figure 6:
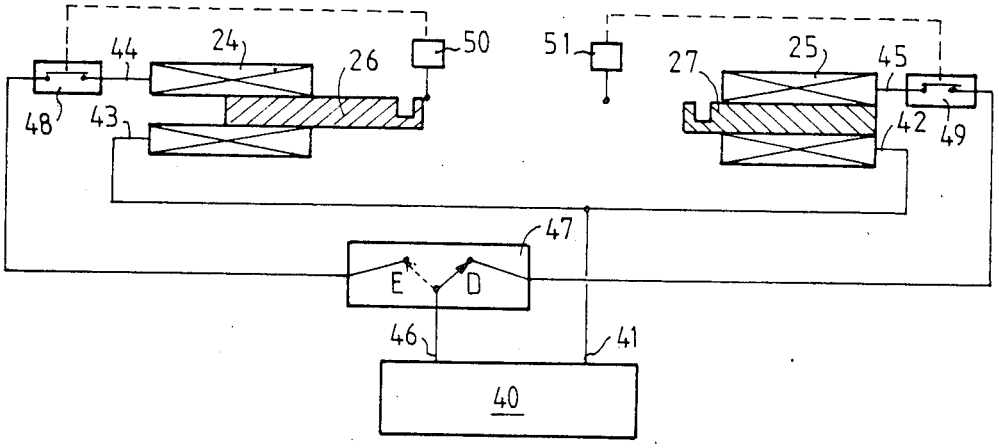
FIG. 6 is a simplified diagram of the circuit for controlling the electromagnets of the electric control device.

The power supply for coils 24, 25 may be provided by means of a supply circuit of the type shown in FIG. 6 which comprises a current souce 40 connected, by one of its terminals 41, to the two ends 42 and 43 of coils 24, 25 and the other terminal 46 of which may be connected either to the end 44 of coil 24 or to the end 45 of coil 25, through a manual or remote controlled switch 47 having a set position E and a tripped position D. Each of the electric connections between switch 47 and the ends 44, 45 of coils 24, 25 further comprises a switch 48, 49 actuated by an end of travel position detector 50, 51 for the corresponding electromagnet core.

The operation of the electric control device is then as follows:

to obtain the set position, switch 47 is placed in position E, which causes the coil 24 of electromagnet 22 to be supplied with power. Under the effect of the electromagnetic forces exerted by this coil 24, core 26 undergoes an axial outward movement which causes lever 30 to rock and drive shaft 39 to rotate. Concurrently, pinion 38 which also meshes with the toothed sector 37 causes lever 31 to rock which pushes back core 27 inside coil 25. At the end of travel, the core 26 actuates the end of travel detector 50 which interrupts the power supply to coil 24, through switch 48, whereas detector 51 which is no longer actuated by core 27 enables the power supply to coil 25.

The tripped position is obtained by a similar procedure, by placing switch 47 in position D, which causes the extension of core 27, rotation in the reverse direction of drive shaft 39 and return of core 26 to the retracted position. Similarly, at the end of the extension travel of core 27, detector 51 interrupts the power supply to coil 25, whereas detector 50 enables the power supply to coil 24.

Thus it can be seen that actuation of one of the cores 26, 27 results in a movement in the reverse direction of the other core. This arrangement has then the advantage of avoiding the need to use return springs. Moreover, because of the end of travel detectors and the switches, when the electric control device 1 is in one of its two states, for example the tripped state, only the setting coil 24 will be enabled to receive an energization current in the next phase.

Figure 4:
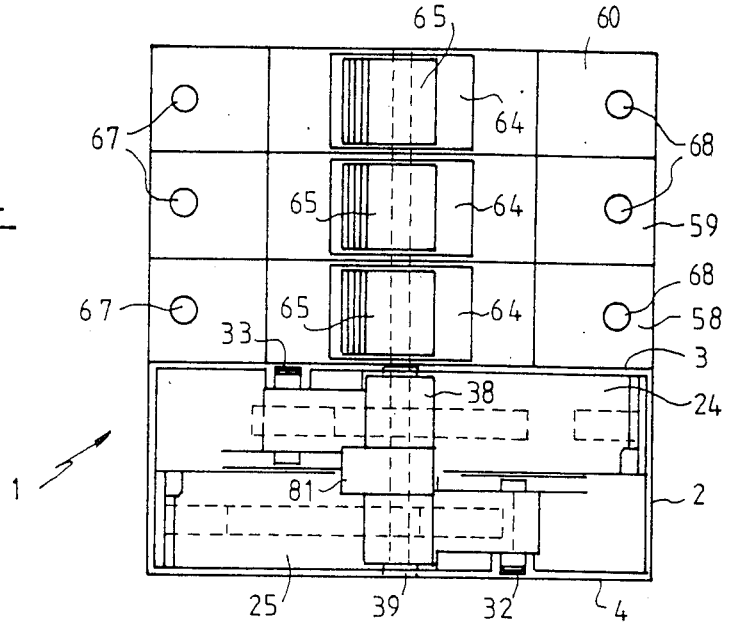
FIG. 4 is a schematical top view of an electric control device of the type shown in FIG. 1 coupled to three modular circuit breakers.
Figure 5:
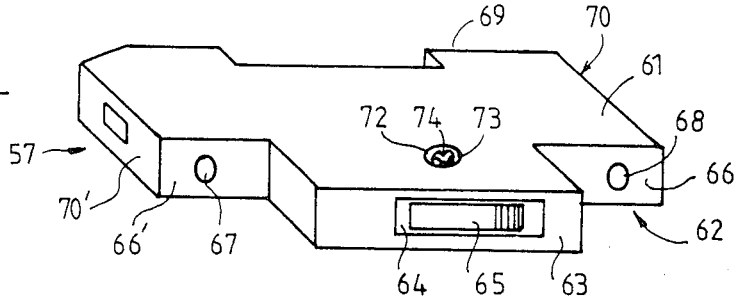
FIG. 5 is a perspective view of a modular circuit breaker of the type used in FIG. 4.

As previously mentioned, the above described electric control device applies to the control of modular circuit breakers, such as circuit breakers 57, 58, 59, 60 shown in FIGS. 4 and 5, which each comprise an electromechanical circuit housed in a flat case which comprises, similarly to the case of the electric control device 1:

two parallel lateral sides 61, 62 against which a simialr adjacent modular circuit breaker may be applied by one of its lateral sides;

a front face having, in its central region, a stepped portion 63 with an opening 64 through which passes a handle 65 for the manual setting and tripping of the circuit breaker and, at the end of its two side regions 66, 66', orifices 67, 68 for access to the electric terminal clamping screws housed in the case;

a rear face 69 whose profile is adapted for fixing it to the support rail 16;

two side faces 70, 70' having in the vicinity of the front side, two respective orifices 71 for fitting electric conductors into these terminals.

Handle 65 is carried by a shaft 72 oriented perpendicularly to the lateral sides 61, 62 and mounted for rotation in two coaxial orifices 73 provided respectively on said sides.

Shaft 72 has a tubular structure whose internal bore 74 is provided with three axial grooves at 120°.

These modular circuit breakers are designed for being assembled side by side on the rail, in a configuration similar to that of circuit breakers 58, 59, 60, whose front face is shown in FIG. 5.

In this position, the shafts 72 of these switches are disposed coaxially, it is therefore possible, to interlock them in rotation by means of a common connecting shaft passing through the bores 74, this shaft having a section substantially complementary to that of said bores.

A very important advantage of the structure of the above described electric control device is that it may be optimally integrated in a case whose form, and in particular the form of the contour of the lateral sides 3, 4 corresponds to those of the cases of modular switches 57 to 60.

With this case 2 fitted against a modular circuit breaker 47 or assembly of modular cases 58, 59, 60 a compact assembly is then obtained free from any discontinuity of form.

In such an assembly, the drive shaft 39 for the electric control device is aligned with the shafts of the modular circuit breakers. Thus, by providing in this drive shaft a bore 76 with a section identical to that of shaft 72, it is possible to interlock these shafts 39 to 72 for rotation by means of a simple connecting shaft of the type described above.

Figure 2:
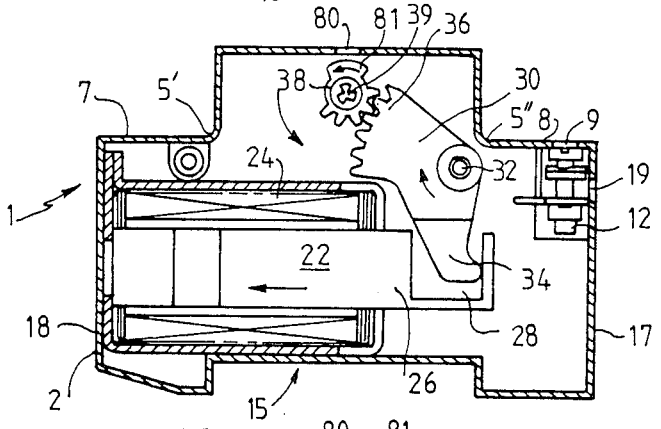
FIGS. 2 and 3 are sections similar to that of FIG. 1, but in which, for facilitating understanding, only the electromagnet serving for setting (FIG. 2) and the coil serving for tripping (FIG. 3) have been shown.
Figure 3:
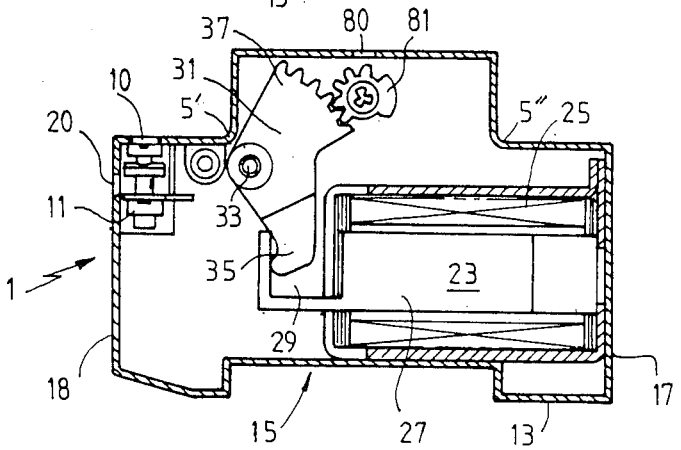

In the examples shown in FIGS. 1 to 3, the central region 6 of the front face of the case of the electric control device 1 has a window 80 in line with the drive shaft. Moreover, pinion 38 has, in a zone which does not mesh with the teeth of lever 30, a sector 81 for displaying the state of the electric control device 1. Thus, in the example shown in FIG. 2, the sector 81 which is situated in line with the window 80 indicates that the device is in the set state. On the other hand, in FIG. 3, the sector 81 is not visible through the window 80, which means that the device is in the tripped state.

Another important advantage of the above described electric control device resides in the fact that when it is assembled with modular circuit breakers, as shown in FIG. 4, the state of these latter may be modified by manual action on handles 65 without any other requirement on the part of the electric control device 1. Furthermore, similarly to the foregoing, the passage from one state to the other of these modular circuit breakers will cause one or other of coils 24, 25 depending on the case to be enabled for the next phase.

In other words, manual actuation of handles 65 cannot in any way cause disturbances to the operation of the electric control device 1.

What is claimed is:

1. An electric control device adaptable to a two state switching device whose switching is controlled by rotation of a shaft between two angular positions each corresponding to one of said states, comprising, housed inside a case:

two electromagnets disposed head to tail and each comprising a coil inside which is mounted for axial sliding a core having first mechanical coupling means;

two levers mounted for rocking about two respective rotational pins orthogonal to the sliding axes of the cores, each lever comprising a first arm having a toothed sector and a second arm having at its free end second coupling means cooperating with the first coupling means of a corresponding core, for transforming opposite linear movements of the two cores into opposite rocking movements of the associated levers;

a toothed pinion mounted for rotation in said case by means of drive shaft parallel to the rotational pins of said levers and with which the two toothed sectors are engaged, this drive shaft being provided with means for coupling to the operating shaft of the switching device; and a power supply circuit adapted for supplying alternately one or other of the coils with power so as to rotate the toothed pinion alternately in one direction or in the other.

2. The device as claimed in claim 1, wherein said power supply circuit comprises, for each of the coils, a switch actuated by a detector detecting the end of travel position of the core corresponding to this coil, so as to interrupt the power supply to this coil when the core has reached said end of travel position.

3. The device as claimed in claim 1, for controlling at least one modular circuit breaker pole of the type comprising an electromagnetic circuit housed in a prismatic case which comprises, in the usual way, two parallel lateral sides and, perpendicularly thereto, a front face having in its central region, an opening through which passes a handle for the manual setting and tripping of the circuit breaker, this handle being carried by an actuating pin mounted for rotation in two coaxial orifices provided respectively in said lateral sides, a rear face whose profile is adapted for fixing it to a support element oriented perpendicularly to said sides, and two opposite lateral faces which may have orifices for fitting electric conductors into terminals housed in the case, these circuit breakers being assembled, lateral sides against lateral sides, on the support element, whereas their actuating pins disposed coaxially with respect to each other may be interlocked with each other, which device further comprises a case having at least one rear face equipped with means for fixing to said support element and, perpendicular to the axis of this support element and to said rear face, two lateral sides against which may be applied a lateral side of a modular circuit breker, said two electromagnets being oriented parallel to said lateral sides and said drive shaft being situated so as to extend coaxially in line with the actuation shaft of this modular circuit breaker.

4. The device as claimed in claim 3, wherein said actuation shaft of the modular circuit breakers as well as said drive shaft for the electric control device have a tubular structure and these shafts are interlocked for rotation by means of a shaft passing through said tubular structures.

5. The device as claimed in claim 4, wherein the front face of said modular circuit breakers as well as the front face of said electric control device have a central region forming a stepped portion and the rotational pins of the levers of said electric control device are situated in the vicinity of the angular regions situated at the base and on each side of the central region of the front face of the case.

6. The device as claimed in claim 1, wherein each of the cores of the coils comprises a transverse recess in which the end of the second arm of the corresponding lever penetrates.

7. The device as claimed in claim 3, wherein the central region of the front face of the case of the electric control device has, in line with the drive shaft, at least one window and the pinion has, in a zone which does not mesh with the teeth of the levers, at least one sector for displaying the state of the electric control device.

* * * * *